United States Patent [19]

Wertepny

[11] 4,152,809

[45] May 8, 1979

[54] TRAVERSE-ROD CONSTRUCTION FOR AUTOMATICALLY PROVIDING EVEN FOLDING AND UNFOLDING OR DRAPERY SUPPORTED THEREBY

[76] Inventor: Joseph R. Wertepny, 1614 Parnell St., Marinette, Wis. 54143

[21] Appl. No.: 790,849

[22] Filed: Apr. 25, 1977

[51] Int. Cl.[2] ..... A47H 5/04

[52] U.S. Cl. ..... 16/96 D; 160/342

[58] Field of Search ..... 16/87.4 R, 95 D, 94 D, 16/96 D; 160/342, 348, 345; 248/263, 277

[56] References Cited

U.S. PATENT DOCUMENTS

| | | | |
|---|---|---|---|
| 1,184,231 | 5/1916 | Dow et al. | 160/342 |
| 2,683,890 | 7/1954 | Rosenbaum | 16/87.4 R |
| 2,880,955 | 4/1959 | Mason | 248/263 |
| 3,013,603 | 12/1961 | Rosenberg et al. | 160/342 |
| 3,045,747 | 7/1962 | Hill | 160/342 X |
| 3,736,620 | 6/1973 | Williamson | 16/87.4 R |
| 3,750,738 | 8/1973 | Powers | 160/342 |

FOREIGN PATENT DOCUMENTS

| | | | |
|---|---|---|---|
| 303940 | 1/1929 | United Kingdom | 160/342 |

*Primary Examiner*—Dorsey Newton

[57] ABSTRACT

A traverse rod for drapes has its pleat hangers attached to elements (e.g. the spaced pivot pins) of a lazy-tong mechanism, whereby the pleats are always evenly spaced regardless of the degree of opening or closing of the drapes. The lazy-tong mechanism (1) can be housed in a rectangular guide box mounted with its longer transverse dimension either vertical or horizontal, or (2) can be attached to hangers carried and guided by a C-shaped channel bar so as to lie behind the drapes carried by the channel bar.

1 Claim, 11 Drawing Figures

Fig. 3
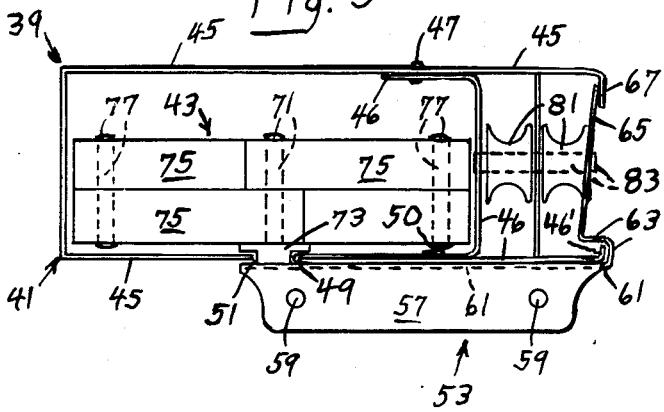
Fig. 4
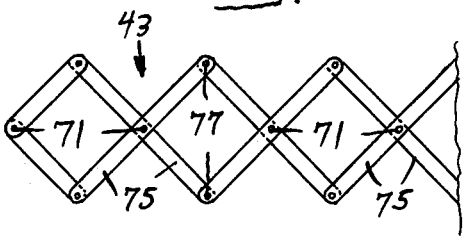
Fig.5A
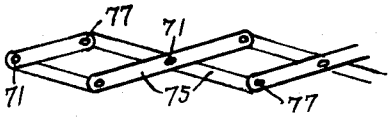
Fig.5B
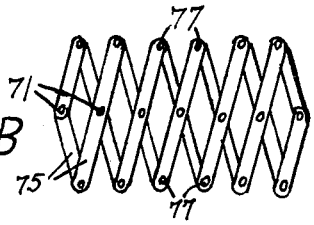
Fig.2
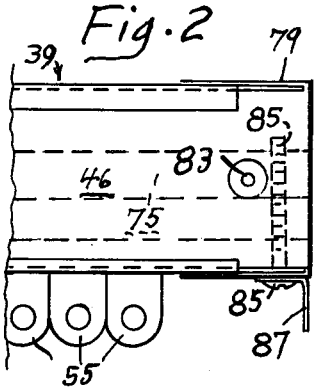
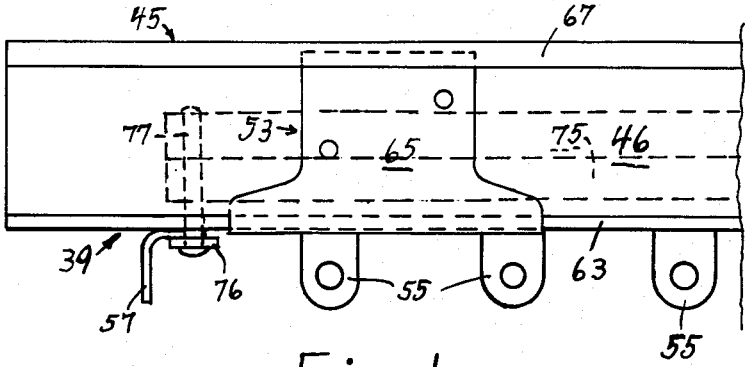
Fig. 1
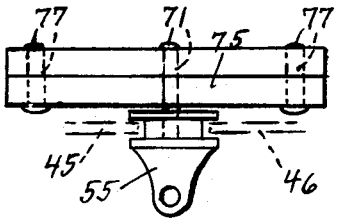
Fig. 6
Fig. 7
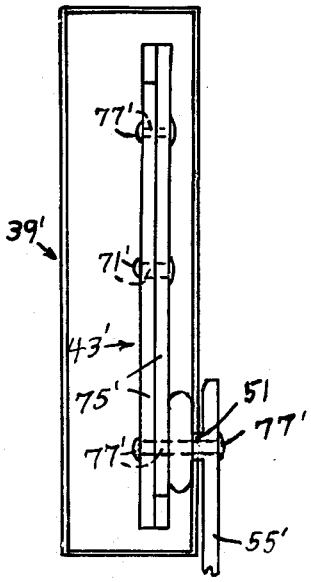

TRAVERSE-ROD CONSTRUCTION FOR AUTOMATICALLY PROVIDING EVEN FOLDING AND UNFOLDING OR DRAPERY SUPPORTED THEREBY

BACKGROUND AND OBJECTS OF THE INVENTION

Presently available traverse rods for supporting drapes cause esthetically objectionable uneven folding or unfolding of the drapes as they are closed or opened. It is accordingly the principal object of this invention to provide a traverse rod constructed for automatically evenly spacing the pleats or folds of drapes regardless of the degree to which they are opened or closed. Other objects and advantages will become apparent as the following detailed description proceeds.

BRIEF DESCRIPTION OF THE DRAWINGS

FIG. 1 is a medial fragmentary rear elevational view of a preferred embodiment of the invention, showing the carrier elements in drape-unfolded positions.

FIG. 2 is a fragmentary view similar to FIG. 1 but showing the carrier elements retracted adjacent the right end of the structure.

FIG. 3 is an end elevational view of the structure of FIGS. 1 and 2 viewed from the left of FIG. 1.

FIG. 4 is a reduced-size fragmentary plan view of the lazy-tong subcombination of FIG. 3 in semi-expanded condition.

FIG. 5A is a fragmentary plan view of the lazy-tong is almost fully expanded condition.

FIG. 5B is a fragmentary plan view of the lazy-tong almost fully closed.

FIG. 6 is an elevatonal view of a single bar-and-carrier subcombination.

FIG. 7 is an end elevational view of a slight modification (90° rotation) of the showing of FIG. 3.

DETAILED DESCRIPTION

Figure 8:
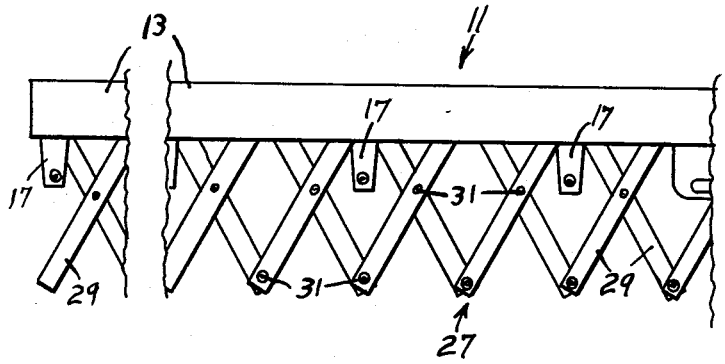
FIG. 8 is a front elevational view of a more simple embodiment of the invention.
Figure 9:
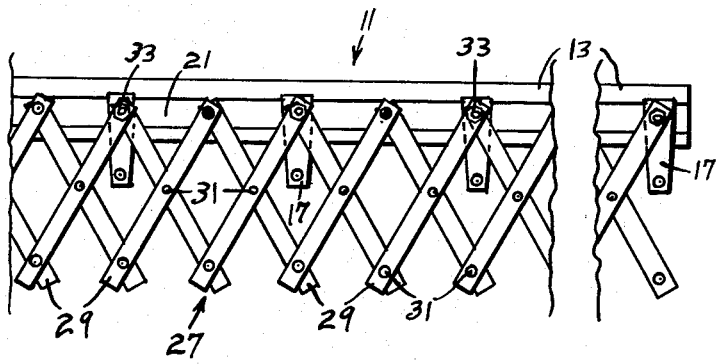
FIG. 9 is a rear elevational view of the species of FIG. 8.
Figure 10:
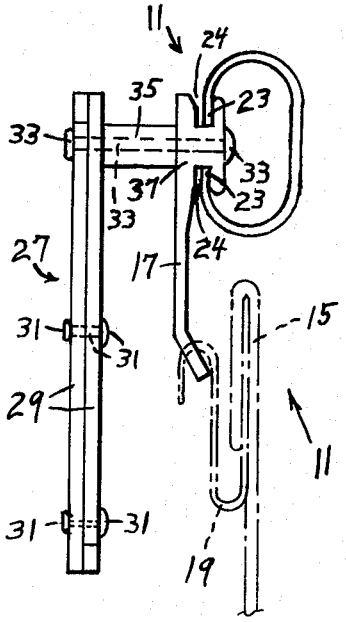
FIG. 10 is an enlarged end elevation of the showing of FIG. 8 viewed from the left.

For easier understanding, the more simple species of FIGS. 8–10 will be considered first. The numeral 11 generally designates the traverse-rod assemblage, the support element of which is a sheet-metal rod 13 of C-shape in cross-section.

A drape or curtain 15 (FIG. 10) is hung from the rod 13 by a plurality of hanger elements 17 molded of a low-friction plastic material. (The drape 15 is fastened to the hanger elements 17 by conventional hook-type pins 19.) Each hanger element 17 is slidably guided in the slot 21 (FIGS. 9 and 10) in the rear vertical face of the rod 13 by its two flanges 23, which engage in the guide depressions 24 in each hanger elements 17.

The hanger elements 17 are connected at spaced intervals along a lazy-tong member 27 formed of parallel sets of straps 29 interconnected by pop-rivet pivot pins 31 and at said spaced intervals by longer pop rivets 33. The pop rivets 33 also pass through spacer sleeves 35 and the hub portions 37 of the hanger elements 17. Thus the lazy-tong mechanism 27, by maintaining even spacing between the hanger elements 17, insures even folding and unfolding of the curtain supported by the assemblage.

With reference now to FIGS. 1–6, the numeral 39 generally designates the preferred embodiment of the invention, which comprises basically an elongated sheet-metal housing 41 of rectangular cross-section and a lazy-tong mechanism 43 enclosed therein. The housing is herein shown as being formed of two strips 45 and 46 spot-welded together, or riveted at 47, at spaced intervals. However, it is contemplated that the housing can alternatively be formed of molded or die-extruded plastics or alloys. The strip 46 is folded upon itself at 49 and welded or riveted at 50 to define with the adjacent edge of the strip 45 the guide slot 51 for receiving the hanger elements 53 and 55. The hanger element 53 is an end element formed of sheet metal and having a downturned flange 57 to provide two hook-receiving apertures 59 for supporting a transverse fold in a drape supported thereby for flatwise abutting a wall or another similarly folded drape. The hanger element 53 underlies the housing strip 46 at 61 and wraps upwardly at 63 over the upstanding short flange 46' for guidance thereby. An upward extension 65 of the hanger element 53 engages behind a downturned flange 67 on the upper reach of the housing strip 45. A pop-rivet 71 fastens the hanger element 53 to the free end of the lazy-tong 43 and carries a circumferentially grooved plastic guide element 76. Other center pop-rivet pivot pins 71 have mounted on their lower ends the other hanger elements 55.

As in the species of FIGS. 8–10 first described, the lazy-tong mechanism 43 comprises a plurality of link elements 75 and interconnecting lateral pop-rivet pivot pins 77.

The right end of the drapery support 39 is closed and supported by a cap 79 which encloses a pair of conventional pulleys 81 for the usual pull cords (not shown). The pulleys are rotatably mounted on an axle 83. A screw 85 serves as the anchor pin for the lazy-tong 43 and attaches the end hanger element to the cap 79.

FIG. 7 illustrates an alternative (vertical) orientation of the housing and shows how the hanger elements can be supported from lateral pivot pairs of the lazy-tong mechanism. Primed numerals indicate parts corresponding to like parts in FIGS. 1–6.

The invention having thus been described, what is claimed as new and patentable is:

1. A device for supporting drapery or like foldable material for lateral hanging movement in covering or uncovering a vertical area, comprising: horizontally disposed guide means, a plurality of separable drapery-type hanger elements movably carried by said guide means, and lazy-tong means interconnecting at least most of said hanger elements for automatically evenly spacing said hanger elements so as to prevent uneven folding or unfolding of said material during uncovering or covering of the area coverable by said material, the end one of said hanger elements being a sheet-material member having a horizontally disposed major portion and a leading-edge-depending plural-apertured drapery-hook-receiving flange extending beneath and substantially at right angle transversely and for more than half the width of said guide means, said guide means being an elongated tubular member wider than tall and housing said lazy-tong means horizontally disposed therein, said hanger elements being supported from the lower ends of lazy-tong pivot pins extending downwardly through a longitudinal slot in the bottom wall of said tubular member, said elongated tubular member being rearwardly open and said sheet-material member having a longitudinally extending upturned flange guidingly engaging at least one margin of the rear opening in said tubular member to maintain the substantially right-angle orientation of the depending flange of said sheet-material member.

* * * * *